United States Patent [19]

Gahler

[11] 3,936,961

[45] Feb. 10, 1976

[54] APPARATUS FOR COVERING DRAINAGE TUBING WITH FINE TEXTURED SOIL GRANULES

[75] Inventor: Lester Gahler, Canby, Oreg.

[73] Assignee: Advanced Drainage Systems, Inc., Columbus, Ohio

[22] Filed: Apr. 25, 1974

[21] Appl. No.: 463,995

[52] U.S. Cl. ..... 37/142.5; 37/80 A; 37/DIG. 16; 61/72.1; 172/764

[51] Int. Cl.[2] ..... E02F 5/22

[58] Field of Search..... 37/80 A, DIG. 16, 142.5, 37/DIG. 6; 172/764; 61/72.1

[56] References Cited

UNITED STATES PATENTS

| | | | |
|---|---|---|---|
| 507,819 | 10/1893 | Keahey | 172/764 X |
| 1,866,037 | 7/1932 | Heim et al. | 37/DIG. 6 |
| 2,150,848 | 3/1939 | Shackleton | 37/80 A |
| 2,223,608 | 12/1940 | George | 37/DIG. 16 |
| 2,602,410 | 7/1952 | Vaughn | 37/142.5 X |
| 3,235,982 | 2/1966 | Krohn | 37/86 X |
| 3,654,713 | 4/1972 | Craddick et al. | 37/804 |

*Primary Examiner*—Clifford D. Crowder
*Attorney, Agent, or Firm*—Connolly and Hutz

[57] ABSTRACT

Device for covering drainage tubing with fine textured soil granules comprises main framework with pair of tillers connected thereto by adjustable connection which varies elevation of tillers relative to main framework. Each tiller includes vertically oriented shaft journaled to secondary frame, and tines extend outwardly from each shaft. Motivators are connected to rotate each shaft so that tines penetrate side walls of trench in which drainage tubing has been positioned to thereby break away fine textured soil granules and shower them over drainage tubing.

3 Claims, 4 Drawing Figures

APPARATUS FOR COVERING DRAINAGE TUBING WITH FINE TEXTURED SOIL GRANULES

BACKGROUND OF THE INVENTION

The present invention relates to a tube bedding device, and more particularly to a device for covering drainage tubing with fine textured soil granules.

Subsurface drainage systems fabricated from corrugated tubes are currently playing a major role in land development and improvement. The advantages of corrugated drainage systems over the heretofore commonly used tile networks are quite numerous. The ease with which corrugated tubes are manufactured in continuous lengths together with the rather simple and inexpensive installation procedures are but a few factors which have contributed to the overwhelming commercial success of corrugated drainage systems. For the most part, such systems include main and lateral subsurface drainage lines comprising corrugated tubing, tees, wyes, couplings or connectors, and adaptors of one type or another. A typical system usually comprises a series of inclined lateral lines spaced from one another in parallel fashion on opposite sides of an inclined main line to which the laterals are conncted by either tees or wyes. The main and lateral lines may be quite long and therefore require the piecing together of various lengths of tubing. End caps are also needed to close the open ends of the main and lateral lines and thereby prevent the surrounding earth from entering into the drainage system.

Regarding the installation procedures, a trenching machine of one type or another may be utilized to dig the required trench. The tubing is then installed within the trench at the bottom thereof, and the trench is then backfilled with the soil initially removed. Generally, during the backfilling operation earth moving equipment is used to simply push the earth back into the trench. Large clumps of heavy soil are filled into the trench and the drainage tube becomes surrounded with these clumps. As a result, the clumps leave a large percentage of void volume which ultimately causes settling of the soil directly above the drainage tube. This settling crushes the tube and reforms the cross section thereof from circular to oval. Such ovalizing of the tube reduces the cross-sectional area thereof, and the load on the tube sometimes damages the tube.

On the other hand, when fine textured soil granules are utilized to bed the tubing, the void volume is significantly reduced. Little if any settling occurs, and the ovalizing of the tube is significantly reduced or completely eliminated. Also, bedding the tube in friable, high density soil provides a natural filter medium for the liquid flowing into the tubing during the drainage operation. Attempts have beem made to initially backfill the trench by manually breaking the clumps and then cover the tube with the thus formed smaller soil pieces. However, such a procedure is time consuming and not completely satisfactory.

SUMMARY OF THE INVENTION

Accordingly, the primary object of the present invention is to provide an efficient and economical mechanical device for covering drainage tubing with fine textured soil granules prior to completing the backfilling of the trench in which the tube is positioned.

In accordance with the present invention a tube bedding device covers drainage tubing with fine textured soil granules. The device comprises a main framework and tiller structure is mounted upon the main framework by an adjustable connection arranged to vary the elevation of the tiller structure relative to the framework. The tiller structure includes at least one shaft with outwardly extending tines connected thereto. A motivator rotates the tiller shaft so that the tines penetrate the side wall of a trench in which tubing has been positioned to thereby break away fine textured soil granules and shower them over the tubing.

Moreover, the tiller structure may include a guide shoe arranged so that the tines extend outwardly therefrom. The shoe engages the side wall of a trench in which the tubing has been positioned to thereby limit penetration of the tines. Also, the adjustable connection between the tiller structure and the main framework may include an internally threaded block on the tiller structure and a vertically oriented lead screw received within the block and journaled to the main frame. A motivator is provided for rotating the lead screw in one direction or the other so that the block rides up and down on the screw to vary the elevation of the tiller structure relative to the main framework. Such adjustment enables the tiller structure to be positioned so that the tines penetrate the most preferred stratum of soil in the side wall of the trench.

Continuing, a pair of secondary frames may be pivotally mounted to the adjustable connection for swinging movement toward and away from one another. The tiller structure then includes a pair of shafts, one journaled to each secondary frame, and the tines extend outwardly from each shaft. A hydraulic motor is connected to rotate each shaft. Preferably, each secondary frame is pivotally secured to the adjustable connection by a vertically oriented pivot pin, and the shafts of the tiller structure are vertically journaled to the secondary frames. A linkage extends between the secondary frames for adjusting the spread of the frames relative to one another.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 1:
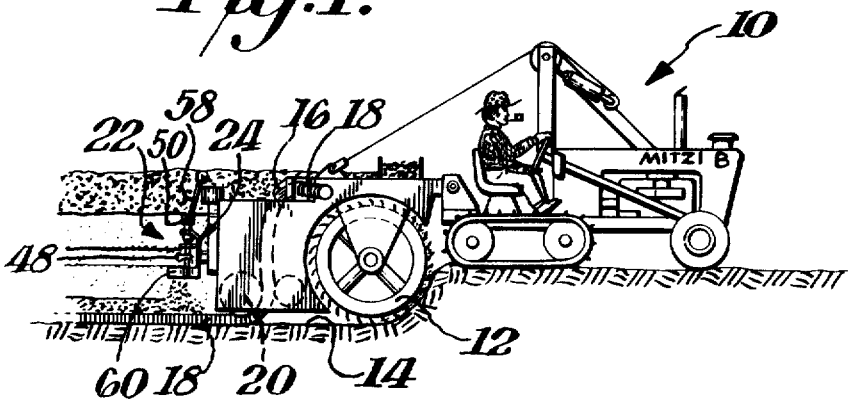
FIG. 1 is a side elevational view of a trenching and tube installing machine including a tube bedding device according to the present invention.

Referring to more particularity to the drawing, FIG. 1 illustrates a conventional trenching machine 10 including a tractor portion and a trenching wheel 12. The wheel is drivingly connected to the tractor and includes cutting scoops or blades which dig a trench 14 as the machine 10 is driven. As is well known, rotation of the trenching wheel 12 removes earth and deposits it alongside of the thus formed trench. The machine 10 forms no part of the present invention and is commercially available from a number of manufacturers. Also, the present invention may be utilized with machines of other design as such machines may be available.

The arrangement shown in FIG. 1 also includes a funnel-shaped guide 16 into which corrugated tubing 18 is delivered. Immediately after entering the funnel-shaped guide 16, the tubing 18 extends downwardly between a pair of rotating feeder rollers 20. These rollers may be configured to conform to the exterior shape of the corrugated tubing and as they rotate the tubing is pulled into the trench and deposited at the bottom thereof. After tubing is so positioned in the trench 14 it only remains to backfill the trench to complete the tube installing procedure.

Figure 2:
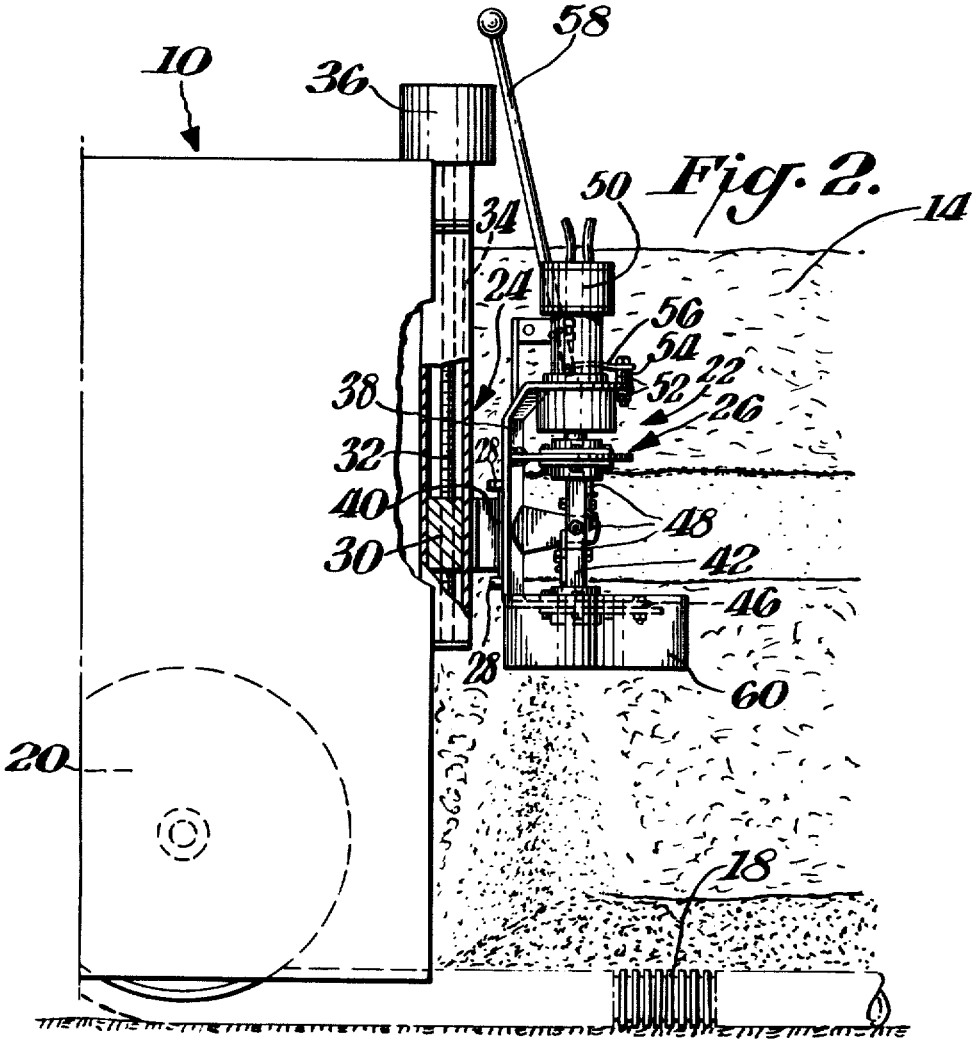
FIG. 2 is a side elevational view of a tube bedding device according to the present invention, with parts broken away to show detail.
Figure 4:
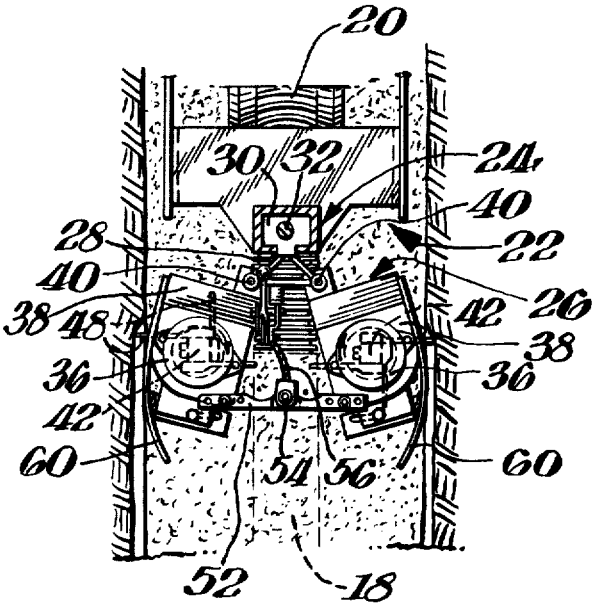
FIG. 4 is a sectional view taken along line 4—4 of FIG. 3.
Figure 3:
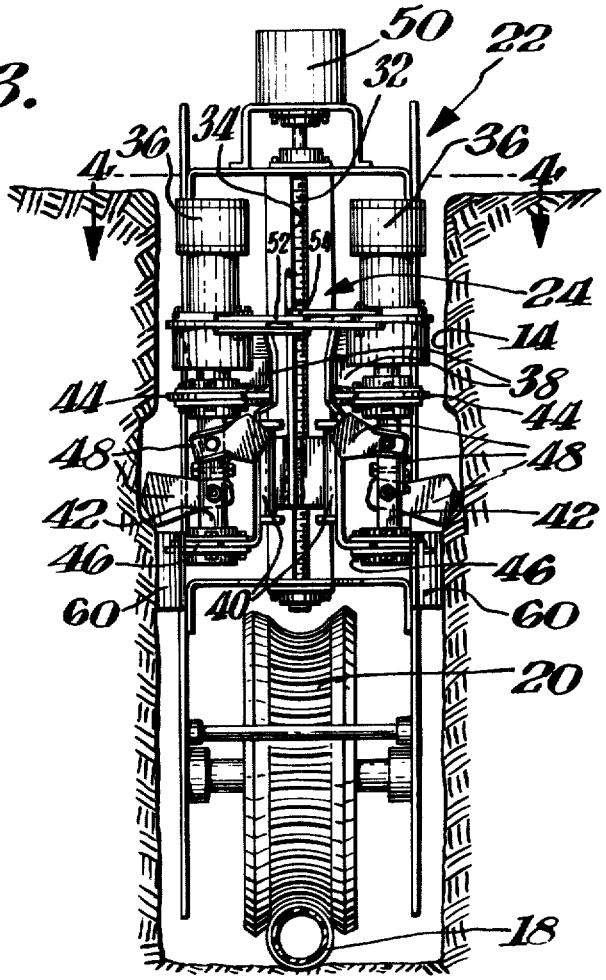
FIG. 3 is a front elevational view of the tube bedding device shown in FIG. 2.

FIGS. 2–4 illustrate the details of the tube bedding machine 22 of the present invention. This machine is secured at the rear end portion of the overall installing apparatus and it functions to cover the tubing 18 in trench 14 with a mass of fine textured soil granules. As explained above, by bedding the tube 18 with material having these characteristics, the resultant mass of earth above the tubing has significantly less void volume when compared to a backfilling operation which merely covers the installed tube with large clumps. ALso, by utilizing this procedure, settling of the soil directly above the tube is substantially or completely eliminated and this prevents crushing or ovalizing of the tube.

Specifically, the tube bedding device 22 comprises main freamework 24 which is anchored to the trenching and tube laying machine. Tiller machine, generally identified by reference numeral 26, is secured to the main framework 24 by an adjustable connection 28 arranged to vary the elevation of the tiller structure 26 relative to the main framework. As explained more fully below, such variation of the elevation of the tiller structure 26 positions the tiller structure at a desired location within the trench 14. As such, one can select the location in the trench from which the bedding soil will be dislodged.

The adjustable connection 28 between the tiller structure 26 and the main framework 24 includes an internally threaded block 30 secured to the tiller structure. Also, the connection includes a vertically oriented rotatable lead screw 32 received within the block 30 and journaled to the main framework 24, as shown best in FIG. 2. The block 30 is dimensioned to fit within a vertical channel 34 which forms part of the framework 24. A hydraulic motor 36 is connected to rotate lead screw 32 in one direction or the other so that threaded block 30 rides up and down on the lead screw within the channel 34 to thereby vary the elevation of the tiller structure 26 relative to the main framework and the trench 14. A suitable operator (not shown) may be provided to control the flow of hydraulic fluid to the motor 36 to thereby rotate the lead screw 32 in one direction or the other depending upon the desired location of the tiller structure 26.

The tiller structure 26 includes a pair of secondary frames 38 pivotally mounted to the adjustable connection 28 for swinging movement toward and away from one another. Each secondary frame 38 is pivotally secured to the internally threaded block 30 of the connection 28 by a vertically oriented pivot pin 40. Moreover, each secondary frame 38 carries a vertically oriented shaft 42 journaled thereto. In this regard, each secondary frame has a pair of spaced apart upper and lower parallel plates 44, 46, and the shaft 42 is journaled to the secondary frame at these plates. Earth digging tines 48 extend outwardly from each shaft 42 for penetration of the side wall of the trench 14 to thereby break away fine textured soil granules therefrom and shower them over the tubing 18, as explained more fully below.

A hydraulic motor 50 is connected to the upper end of each shaft 42 of the tiller structure 26. The motor 50 is anchored to the secondary frame 38, and suitable hydraulic lines connect each motor to a controlled source of hydraulic fluid. The operator of the vehicle merely controls the flow rate of hydraulic fluid to the motors 50 to thereby control the rotational speed of the digging tines 48.

A two-piece linkage 52 extends between the secondary frames 38 of the tiller structure 26. One end of each link of the linkage 52 is pivotally connected to one of the secondary frames 38, and the links are pivotally connected together at 54, as shown best in FIG. 4. The linkage 52 is connected by a rod 56 to a lever operator 58 for the linkage. The arrangement of the operator 58 is such that when it is pulled downwardly and rearwardly, the connecting rod 56 pulls the linkage 52 in a forward direction and this causes each of the secondary frames to move toward one another. Obviously, reverse movement of the lever 58 extends the effective length of the linkage 52 to thereby spread the secondary frames apart.

A guide shoe 60 is secured to each secondary frame 38 of the tiller structure 26. As shown best in FIG. 2, the guide shoe is secured to the lower plate 46 of each secondary frame. The location of the guide shoe relative to the secondary frame 38 is such that the earth digging tines 48 extend outwardly from the exterior surface of the shoe. As a result of this relationship, the guide shoes 60 function to limit the penetration of the tines 48 into the side walls of the trench 14.

As noted above, the function of the tube bedding machine 22 is to provide a desirable bedding material for surrounding the drainage tube 18. By providing such material for the bedding operation the tube is properly installed and functions indefinitely for the purpose it was designed. After a portion of the trench 14 has been dug, the side wall of the trench is examined to determine the best location from which the bedding material should be taken. The elevation of the tiller structure 26 is then adjusted so that earth digging tines will penetrate the trench side walls at the desired location. This is accomplished by delivering hydraulic fluid to the motor 36 which then causes the lead screw 32 to rotate. Such rotation causes a simultaneous movement of the threaded block 30 which then adjusts the position of the tiller structure 26 to the desired predetermined elevation.

During the above preliminary manipulations, the lever operator 58 for the linkage 52 is in its downward position whereby the secondary frames 38 are close to one another and the guide shoes 60 are out of contact with the side walls of the trench. After completion of the adjustment of the elevation of the tiller structure 26 the lever operator 58 is moved to its upward position which causes the secondary frames to pivot about the pins 40 away from one another. Ultimately, the earth digging tines penetrate into the desired soil stratum in the side walls of the trench and the shoes 60 engage the side walls to limit further penetration of the tines. The tube bedding machine 22 is then ready to envelop the tube 18 in a desired bedding material.

The hydraulic lines to the motors 50 are arranged so that each shaft 42 rotates in a direction that aids in propelling the trenching machine 10 in a forward direction. In other words, when viewed as shown in FIG. 4, the motor 50 to the left of the figure rotates in a counterclockwise direction while the righthand motor rotates in a clockwise direction. Needless to say, such movement conserves energy when compared to rotational directions which oppose the forward travel of the machine. Also, the guide shoes 60, by controlling the depth of penetration of the tines 48, prevent one set of tines from fighting the other in favor of a less dense side of the trench. Moreover, and most important, the shoes 60 maintain the device in proper alignment during the installation operation.

During the trenching operation the motors 50 are energized and the tines 48 dig into the side walls of the trench 14 to remove soil therefrom in the form of fine textured soil granules. These granules fall onto the tubing 18 in the bottom of the trench to thereby envelop the tubing in a friable, high density soil. The overall thickness of the soil covering the tubing depends upon the rotational speed of the shafts 42 and the linear speed at which the tubing is installed. Either variable can be altered to thereby deposit the required amount of bedding material upon the tubing. After the tube is bedded in fine textured soil granules at least 3–5 inches thick, the backfilling operation is completed by pushing the earth piled alongside the trench back into the trench.

What is claimed is:

1. A device for covering drainage tubing with fine textured soil granules comprising a main framework, a pair of secondary frames mounted for swinging movement toward and away from one another about at least one vertically oriented axis, an adjustable connection between the main framework and the secondary frames including a motivator for varying the elevation of the secondary frames relative to the main framework, tiller means connected to the secondary frames including a pair of vertically oriented shafts, one journaled to each secondary frame, tines secured to and extending outwardly from each shaft, motivating means connected to rotate each shaft whereby the tines penetrate the side walls of a trench in which tubing has been positioned to thereby break away fine textured soil granules therefrom and shower them over the tubing, and a guide shoe connected to each secondary frame for engaging the side walls of the trench to thereby limit the penetration of the tines.

2. A device as in claim 1 wherein the adjustable connection between the tiller means and the main framework includes an internally threaded block secured to the tiller means, and a vertically oriented lead screw received within the block and journaled to the main framework, and wherein the motivator rotates the lead screw in one direction or the other whereby the block rides up and down on the lead screw to vary the elevation of the tiller means relative to the main framework.

3. A device as in claim 1 including a linkage extending between the secondary frames for adjusting the spread thereof relative to one another.

* * * * *